US007213957B1

(12) United States Patent
Fitzpatrick

(10) Patent No.: US 7,213,957 B1
(45) Date of Patent: May 8, 2007

(54) LIGHTED CHRISTMAS STAR ORNAMENT APPARATUS

(76) Inventor: Candy Fitzpatrick, P.O. Box 193, Moose Pass, AK (US) 99631

( * ) Notice: Subject to any disclaimer, the term of this patent is extended or adjusted under 35 U.S.C. 154(b) by 0 days.

(21) Appl. No.: 11/150,677

(22) Filed: Jun. 9, 2005

Related U.S. Application Data

(60) Provisional application No. 60/580,121, filed on Jun. 17, 2004.

(51) Int. Cl.
*F21V 7/07* (2006.01)

(52) U.S. Cl. ..... 362/566; 362/807

(58) Field of Classification Search ..... 362/806, 362/807, 249, 566, 250
See application file for complete search history.

(56) References Cited

U.S. PATENT DOCUMENTS 2,486,636 A * 11/1949 Egle ..... 362/257
3,272,976 A * 9/1966 Charchan et al. ..... 362/121
4,930,053 A * 5/1990 Vaught ..... 362/121
6,712,493 B2 * 3/2004 Tell et al. ..... 362/565
6,783,259 B1 * 8/2004 Macedonio ..... 362/251
2003/0156411 A1 * 8/2003 Ahroni ..... 362/249
2004/0100797 A1 * 5/2004 Yang ..... 362/252

* cited by examiner

*Primary Examiner*—Thomas M. Sember
*Assistant Examiner*—Julie A. Shallenberger
(74) *Attorney, Agent, or Firm*—Michael J. Tavella

(57) ABSTRACT

A lighted star ornament that is freestanding, and designed for use with a nativity set. A multi-faceted star is affixed atop a telescoping support post, the bottom of which is attached to a support base housing a battery or electrical power pack. Running through the support posts are electrical wires, which connect the power source to a socket into which a lamp bulb is secured. The socket and bulb assembly fits into a hollowed space in the back center of the star. The star may be easily disassembled from the socket assembly and reattached to it. An on/off switch operates the light on the star. The star can have points or five points, or any number of points desired.

17 Claims, 4 Drawing Sheets

LIGHTED CHRISTMAS STAR ORNAMENT APPARATUS

CROSS REFERENCE TO RELATED APPLICATIONS

This application claims the benefit of Provisional Application No. 60/580,121, filed Jun. 17, 2004.

STATEMENT REGARDING FEDERALLY SPONSORED RESEARCH AND DEVELOPMENT

Not Applicable

BACKGROUND OF THE INVENTION

1. Field of the Invention

This invention relates a freestanding lighted star ornament that can be used with a nativity set. The, multi-faceted star is affixed to the top of a telescoping support post that allows the height to be adjusted.

2. Description of the Prior Art

Christmas has become a popular cultural holiday that is observed by people around the world. One of the most common traditional symbols of Christmas is the nativity scene, which represents the circumstances of the birth of Jesus. The nativity scene is typically represented as being in a stable at Bethlehem, where the baby is lying in a cradle surrounded by his parents, shepherds, wise men, and animals.

A symbol that is central to the nativity scene is the Christmas Star, which is said to have appeared in the sky over Bethlehem at the place where Jesus was born.

The Star represents the age-old procession of people journeying to places of pilgrimage, on the spiritual quest. Many Christmas stars have either five or eight points, with the bottommost point being a directional indicator of a point on the earth, below.

Unfortunately, the majority of nativity sets found throughout the world do not include an actual lighted star. Outdoor crèches are typically housed within some sort of enclosure, and that enclosure is often lighted at the dome or with lighting placed on the ground before the enclosure, directed to illuminate the crèche scene. In the case of indoor nativity scenes, however, an illuminated star is not typically found as an element included with the crèche figures.

A wide variety of star ornaments exists, which are designed for use on a Christmas tree. Some may be attached to the tree with ornament hooks, or by balancing them between the tree's boughs. Others are intended to be placed at the top of the tree. In order to create a distinctive presence, such ornaments are generally lighted, and are sized proportionate to a Christmas tree. Treetop stars are typically made to fit onto the topmost branch of a tree, or have a clip or other fixture by which they are attached and are not typically freestanding ornaments.

Other star designs use a fabric skin that is stretched over a dowel assembly in the shape of a five-pointed star. Decorative light bulbs may be placed in the assembly to illuminate the ornament. The ornament may be propped against or affixed to a variety of objects, but is not freestanding.

Another ornament is a five-pointed star, designed for outdoor use. It is comprised of a tubular skeleton with support legs in a tripod configuration that allow the device to be stood upright. A strand of decorative outdoor lights are attached to the entire structure so that its tubular skeleton is lighted. Such an ornament is not designed to be elevated above a typical indoor crèche.

Still other ornaments are found in star-shaped designs that are different from the typical star design of five or eight points. For example, ornaments are found in the design of the Star of David, which is a six-sided shape within which is a six-pointed star. Such ornaments are very different from the traditional Christmas Star design. Five-pointed ornamental stars are also decorated in a patriotic motif representative of the U.S. flag, with a stars and stripes pattern across the face of the star. Clearly, such a design would not be likely to find use in a nativity scene.

Therefore, what is desired is a lighted star ornament designed to be freestanding for use with a nativity crèche or for simple ornamentation in itself.

BRIEF DESCRIPTION OF THE INVENTION

The instant invention is a star ornament made of a multi-faceted transparent material such as glass, plastic, acrylic, crystal, and a lightweight metal or finely meshed material. It has an opening in the back center of the star into which one or more lamp bulbs may be placed. The star is supported by a telescoping post. A socket fixture, into which a lamp bulb may be secured, is placed at the top of the post. The lamp socket is wired with electrical wire, which is strung through the center of the support post. The post sits on a support base made of plastic, wood, metal or other material. The base contains a battery or electrical power pack to energize the lamp. The device is controlled by a switch and a safety fuse can be provided, which protects the electric circuit from excessive current. In the preferred embodiment, the star is an eight-pointed star. However, the star can have other shapes, such as a five-pointed star.

It is thus an object of the invention to produce a star ornament that is freestanding, so that it is easy to incorporate it as an element of a crèche.

It is another object of the invention to produce a star ornament that is freestanding for a simple display of a star in any desired location.

It is yet another object of the invention to produce a star ornament that is illuminated to increase its aesthetic effect.

It is a further object of the invention to produce a star ornament to fit a traditional star motif for the Christmas holiday season.

DETAILED DESCRIPTION OF THE INVENTION

Figure 1:
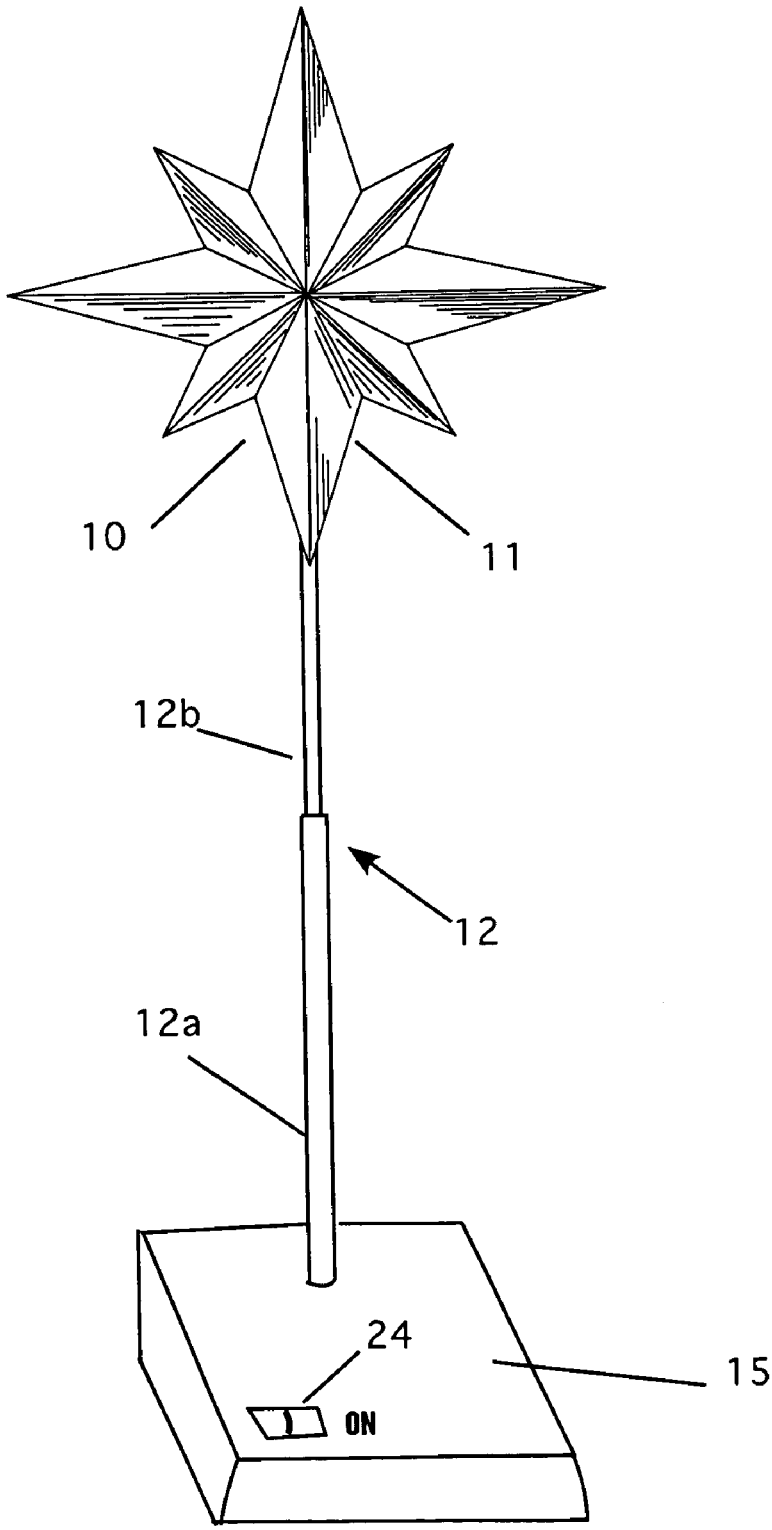
FIG. 1 is a front view of the preferred embodiment of the apparatus.
Figure 2:
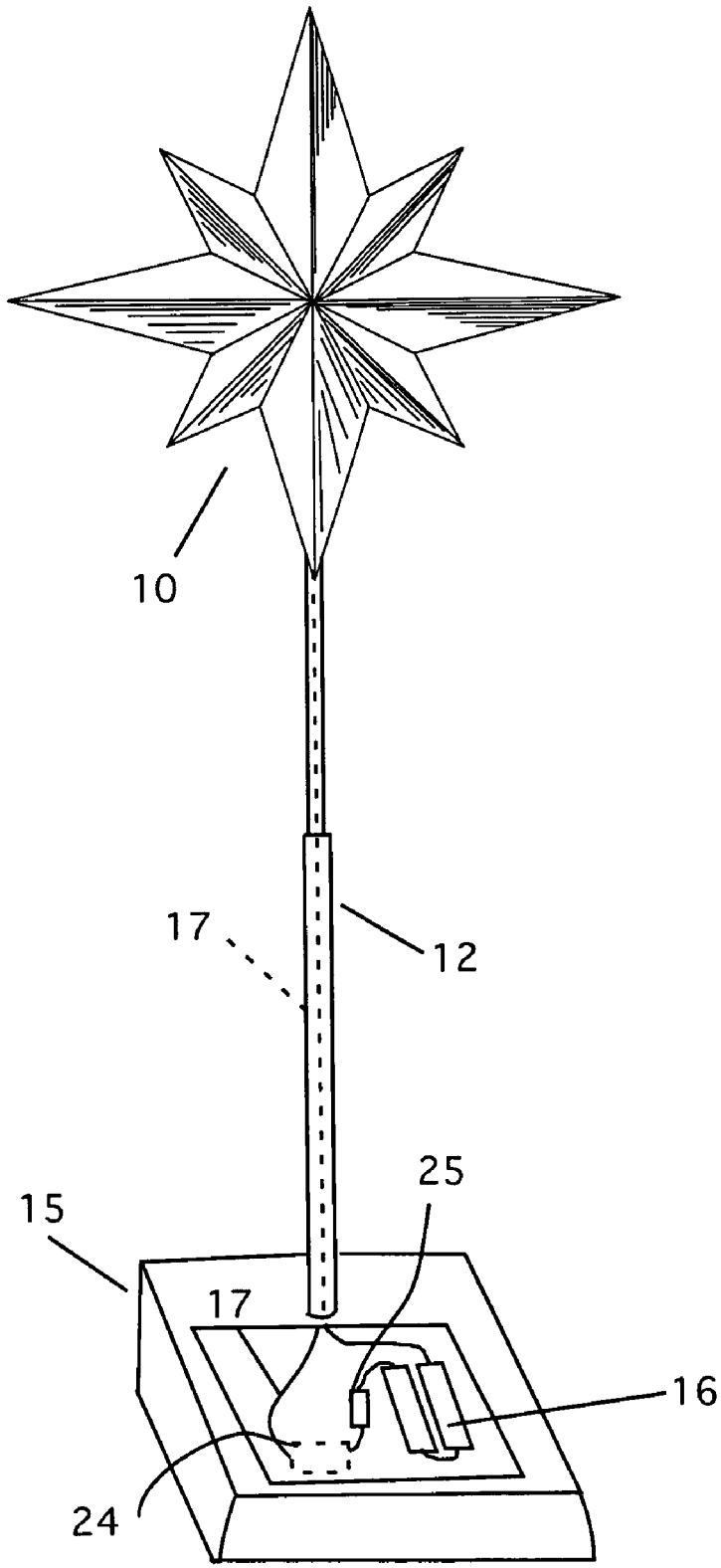
FIG. 2 is a front view of the preferred embodiment of the apparatus, showing a partial cutaway view of the base.
Figure 3:
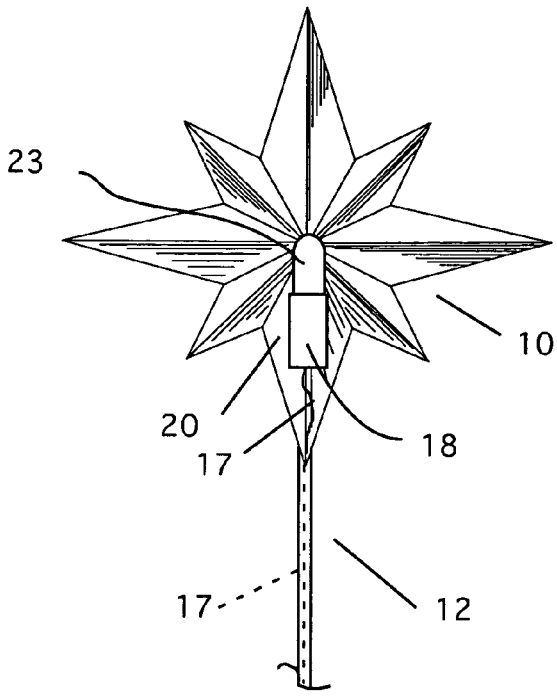
FIG. 3 is a rear view of the preferred embodiment of the invention showing a single bulb installation.

Referring now to FIGS. 1, 2 and 3, a freestanding, lighted star ornament is shown. In the preferred embodiment, the star 10 is an eight-pointed star with a multi-faceted surface 11 that is made of a transparent material (e.g., glass, plastic, crystal, finely meshed metal material), which is affixed to the topmost part of a support post 12. The support post 12 is designed to telescope and is made of two or more sections 12*a* and 12*b*, section 12*b* fits snugly inside section 12*a* to be 'telescoped' up or down. The bottommost part 12*a* of the support pole is attached at its bottom to a support base 15 that is made of plastic, wood, metal or other material. The base 15 supports the device and also contains a battery or electrical power pack 16 that is attached by electrical wires 17 running through the center of the support post 12 to the electrical socket 18 placed in the star ornament (see FIG. 3). Although the preferred embodiment uses an eight-point star, any other style of star, e.g., a five-pointed star (see FIG. 4) can be used.

FIG. 2 shows the inside of the base. FIG. 2 shows the battery or power pack 16 in the base 15. A switch 24 is attached in the circuit to control the operation of the bulb 23. Finally, a safety fuse 25 may be used to protect the electric circuit from excessive current.

FIG. 3 shows the backside of an eight-pointed star 10, which has a hollowed opening 20 into which one lamp socket 18 may be fitted. The socket then has a bulb 23 to illuminate the star.

Figure 4:
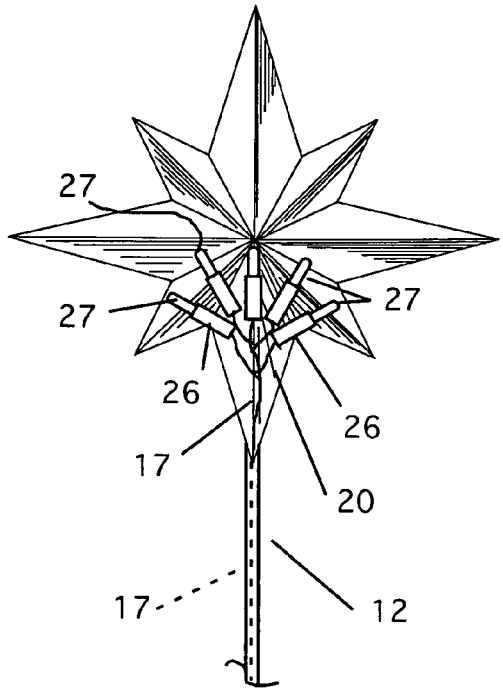
FIG. 4 is a rear view of the preferred embodiment of the invention showing a multiple bulb installation.

FIG. 4 shows the backside of an eight-pointed star 10, which has a hollowed opening 20 into which several sockets 26 have been fitted. Here, several bulbs 27 can be used to add to the lighted display.

Figure 5:
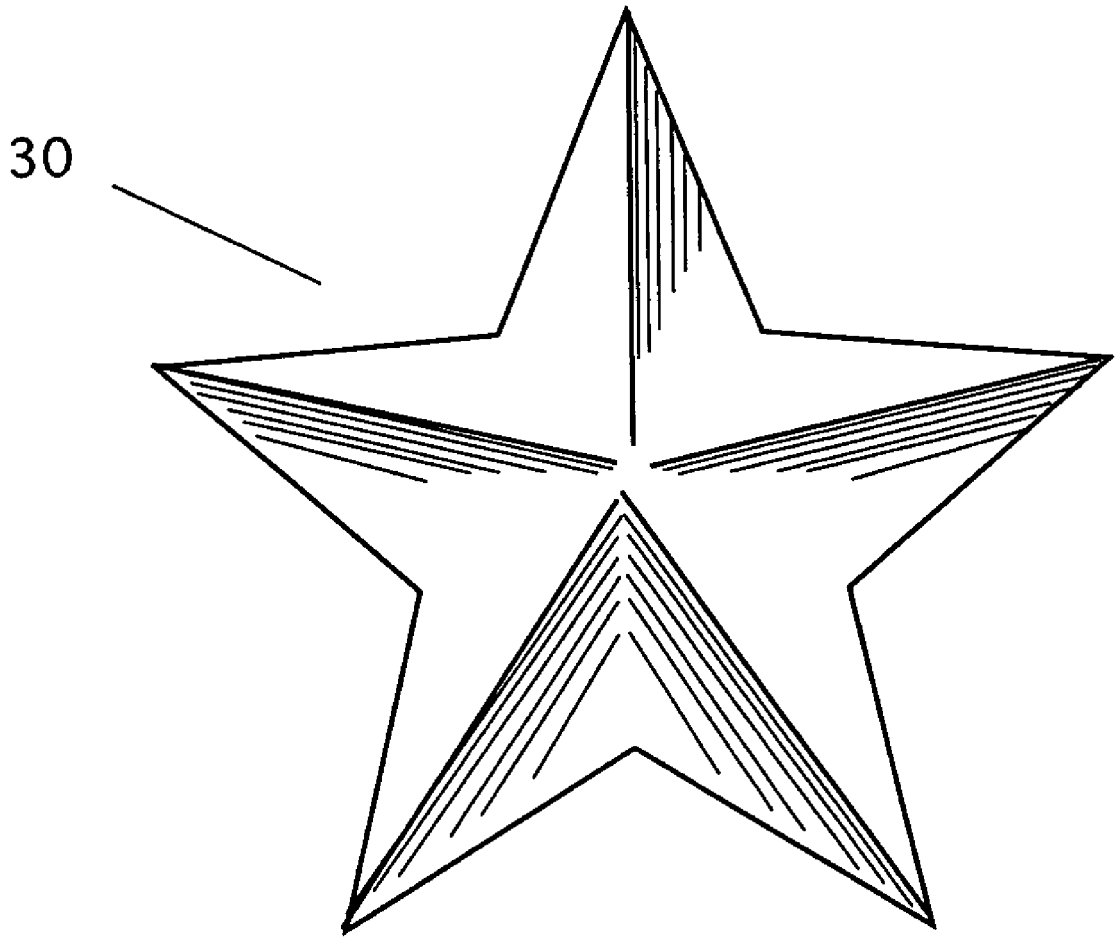
FIG. 5 is a front view of a five-pointed star, which can be used as an alternative to the eight-pointed star.

FIG. 5 shows a five-pointed star 30 that can be used in place of the eight-pointed star of the preferred embodiment. Although the eight and five point stars would be the most common, any other shaped star may be used The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A freestanding lighted star ornament, comprising:

a) a star, having a multi-faceted surface of a transparent material that reflects lights in a plurality of directions, said star having a back side, said back side of said star having a hollow opening therein;

b) a tubular support pole, having a distal end and a proximate end, whereby the distal end of said tubular support pole being attached to said star;

c) an electrical socket affixed to the distal end of said tubular support post;

d) a lamp bulb, operably installed in said electrical socket;

e) a support base, having an outer surface, affixed to the proximate end of said tubular support post;

f) an electrical power source, placed in said support base; and g) a pair of electrical wires, in electrical communication with said electrical power source and said electrical socket.

2. The apparatus of claim 1 wherein the tubular support pole is telescoping.

3. The apparatus of claim 1 further comprising a switch in electrical communication with said electrical power source and said electrical socket.

4. The apparatus of claim 1 wherein the star is made of a material selected from the group of glass, plastic, crystal, or finely meshed metal material.

5. The apparatus of claim 1 wherein the hollow opening on the back side of the star is positioned in the center of the back side of the star.

6. The apparatus of claim 1 wherein the pair of electrical wires extends from said support base to said electrical socket within the tubular support post.

7. The apparatus of claim 1 further comprising a safety fuse, in operable electrical communication with said electrical power source.

8. The apparatus of claim 1 wherein the star has eight points.

9. The apparatus of claim 1 wherein the star has five points.

10. The apparatus of claim 1 wherein the electrical power source is a battery.

11. A freestanding lighted star ornament, comprising:

a) a star, having a multi-faceted surface of a transparent material that reflects lights in a plurality of directions, said star having a back side, said back side of said star having a hollow opening therein;

b) a tubular support pole, having a distal end and a proximate end, whereby the distal end of said tubular support pole being attached to said star;

c) a plurality of electrical sockets affixed to the distal end of said tubular support post;

d) a plurality of lamp bulbs, wherein on of said plurality of lamp bulbs is operably installed in said each of said plurality of electrical sockets;

e) a support base, having an outer surface, affixed to the proximate end of said tubular support post;

f) an electrical power source, placed in said support base; and g) a pair of electrical wires, in electrical communication with said electrical power source and said plurality of electrical sockets.

12. The apparatus of claim 11 wherein the tubular support pole is telescoping.

13. The apparatus of claim 11 further comprising a switch in electrical communication with said electrical power source and said plurality of electrical sockets.

14. The apparatus of claim 11 wherein the star is made of a material selected from the group of glass, plastic, crystal, or finely meshed metal material.

15. The apparatus of claim 11 wherein the hollow opening on the back side of the star is positioned in the center of the back of the star.

16. The apparatus of claim 11 wherein the pair of electrical wires extends from said support base to said socket within the tubular support post.

17. The apparatus of claim 11 wherein the electrical power source is a battery.

* * * * *